US007895688B1

(12) United States Patent
Rowes et al.

(10) Patent No.: US 7,895,688 B1
(45) Date of Patent: Mar. 1, 2011

(54) DECUBITI ULCER SYSTEM

(76) Inventors: Jay Ronald Rowes, Wareham, MA (US); Malcolm C. Winsor, Mount Vernon, NH (US); David A. Zlotek, Nashua, NH (US)

( * ) Notice: Subject to any disclaimer, the term of this patent is extended or adjusted under 35 U.S.C. 154(b) by 0 days.

(21) Appl. No.: 12/287,708

(22) Filed: Oct. 10, 2008

Related U.S. Application Data

(60) Provisional application No. 60/978,981, filed on Oct. 10, 2007.

(51) Int. Cl.
*A47B 7/00* (2006.01)
*A61G 5/00* (2006.01)

(52) U.S. Cl. ..... 5/612; 5/607; 5/609; 5/88.1; 5/81.1 R

(58) Field of Classification Search ..... 5/609, 607, 5/608, 612, 120, 81.1 R, 81.1 HS, 81.1 C; 198/321; 193/35 R
See application file for complete search history.

(56) References Cited

U.S. PATENT DOCUMENTS 3,302,219 A * 2/1967 Harris ..... 5/85.1
3,875,598 A * 4/1975 Foster et al. ..... 5/607
3,924,281 A * 12/1975 Gibbs ..... 5/88.1
4,222,133 A * 9/1980 Csatary ..... 5/604
4,270,234 A * 6/1981 James ..... 5/88.1
4,357,722 A * 11/1982 Thompson ..... 5/606
4,843,665 A * 7/1989 Cockel et al. ..... 5/88.1
4,945,585 A * 8/1990 Stewart ..... 5/122
5,018,225 A * 5/1991 Fergni et al. ..... 5/607
5,054,140 A * 10/1991 Bingham et al. ..... 5/600
6,651,281 B1 * 11/2003 Figiel ..... 5/612
2007/0151025 A1 * 7/2007 Wei et al. ..... 5/81.1 R
2008/0047067 A1 * 2/2008 Hornbach ..... 5/607
2009/0013469 A1 * 1/2009 Johnson ..... 5/612

* cited by examiner

*Primary Examiner* — Robert G Santos
*Assistant Examiner* — Brittany M Wilson
(74) *Attorney, Agent, or Firm* — Blodgett & Blodgett, P.C.; Gerry A. Blodgett

(57) ABSTRACT

A system and procedure for preventing and enhancing healing of Decubiti ulcers on patients, comprising the steps of placing the patient on a web adapted to support the patient, the web having a patient contacting portion and a non-patient contacting portion, the web having an opening through the web, positioned so that the opening surrounds the ulcer and prevents contact of the web with the ulcer, and using a web support system adapted to support the web by attachment only to the non-patient contacting portion, to solely support the web with a patient on it. The procedure may also include a step wherein a rocking device is used that acts through the web support system to selectively tilt the web and thereby to tilt the patient on the patient contact portion of the web, so that the pressure between the patient and the web is cyclically altered.

10 Claims, 2 Drawing Sheets

DECUBITI ULCER SYSTEM

CROSS-REFERENCE TO RELATED APPLICATIONS

This application claims the benefit under 35 U.S.C. section 119(e) of U.S. provisional patent application No. 60/978,981 filed Oct. 10, 2007, all of which is hereby incorporated by reference.

STATEMENT REGARDING FEDERALLY SPONSORED RESEARCH OR DEVELOPMENT

This invention has been created without the sponsorship or funding of any federally sponsored research or development program.

REFERENCE TO SEQUENCE LISTING, A TABLE, OR A COMPUTER PROGRAM LISTING COMPACT DISK APPENDIX

Not applicable.

THE FIELD OF THE INVENTION

This invention involves a system for treatment of decubiti ulcers.

BACKGROUND OF THE INVENTION

A Decubiti ulcer/pressure sore/bed sore is formed when a reduction in capillary blood flow within the human tissue results in pressure from weight or bone in a patient that is unable to change position over a prolonged period of time resulting in necrosis; ulceration and inability to self heal.

Decubiti ulcers are an extremely serious condition. The ulcer itself can cause the patient extreme discomfort. Furthermore, the other ulcer or ulcer itself can have significant medical complications because it can result in serious and irreversible tissue destruction. In addition, the open sore aspect of the ulcer and its direct exposure to bedding that itself may be soaked with urine, fecal matter, and other bodily fluids can easily result in secondary infections including developing strains of antibiotic resistance bacteria and virus forms. These complications can be very destructive and even fatal, especially in transplant patients with suppressed immune systems or other patients with suppressed immune systems.

Decubiti ulcers are extremely common. Any bedridden population, especially patients in hospitals, nursing homes, and homebound situations, have a very high likelihood of experiencing Decubiti ulcers, even under the best of circumstances. Patience in less then perfect environments are essentially guaranteed of suffering from this condition.

Medical management of Decubiti ulcers is very challenging. The standard of care for Decubiti ulcer is rotation of the patient every 2 hours, minimize shearing of the skin and minimize risk of infection, and very frequent changing of soiled bedding. Because the presence medical management of Decubiti ulcers is currently an entirely manual operation, imposing huge physical and time burdens on nursing staff, and because the constant changing of soiled bedding increases the laundry management load, the management of Decubiti ulcers places on an enormous burden on the facility in which the patient resides. In facilities and in situations where economic and staffing issues become significant, there is a very high likelihood that constantly maintaining the highest standard of care in connection with Decubiti ulcers can be impossible, as a practical matter.

These and other difficulties experienced with the prior art devices have been obviated in a novel manner by the present invention.

It is, therefore, an outstanding object of some embodiments of the present invention to provide a decubiti ulcer treatment system that achieves the highest possible level of medical effectiveness.

It is a further object of some embodiments of the invention to provide a decubiti ulcer treatment system that achieves the highest level of patient comfort.

It is a still further object of some embodiments of the invention to provide a decubiti ulcer treatment system that provides the facility and staff with the highest level of convenience, effectiveness, and efficiency.

With these and other objects in view, as will be apparent to those skilled in the art, the invention resides in the combination of parts set forth in the specification and covered by the claims appended hereto, it being understood that changes in the precise embodiment of the invention herein disclosed may be made within the scope of what is claimed without departing from the spirit of the invention.

BRIEF SUMMARY OF THE INVENTION

Generally, some embodiments of this invention are a patient support system adapted to support a patient, comprising a web adapted to support the patient, the web having a patient contacting portion and a non-patient contacting portion, a web support system adapted to support the web by attachment only to the non-patient contacting portion, and a rocking device that acts through the web support system to selectively tilt the web and thereby to tilt the patient on the patient contact portion of the web, so that the pressure between the patient and the web is cyclically altered. The patient support system may also include an opening having a outer boundary and formed through the web and positioned to surround a wounded part of the patient's body so that the web does not contact the wounded part of the patient's body.

Some embodiments of this invention are a patient support system adapted to support a patient with a wound, comprising a web adapted to support the patient, the web having a patient contacting portion and a non-patient contacting portion, a web support system adapted to support the web by attachment only to the non-patient contacting portion of the web, and an opening having a outer boundary and formed through the web and positioned so that the boundary surrounds the wounded part of the patient's body so that the web does not contact the wounded part of the patient's body.

Some embodiments of this invention are a procedure for preventing Decubiti ulcers on patients, comprising the steps of placing the patient on a web adapted to support the patient, the web having a patient contacting portion and a non-patient contacting portion, using a web support system adapted to support the web by attachment only to the non-patient contacting portion, to solely support the web with a patient on it, and using a rocking device that acts through the web support system to selectively tilt the web and thereby to tilt the patient on the patient contact portion of the web, so that the pressure between the patient and the web is cyclically altered.

Some embodiments of this invention are a procedure for enhancing healing of Decubiti ulcers on patients, comprising the steps of placing the patient on a web adapted to support the patient, the web having a patient contacting portion and a non-patient contacting portion, the web having an opening through the web, positioned so that the opening surrounds the ulcer and prevents contact of the web with the ulcer, and using a web support system adapted to support the web by attachment only to the non-patient contacting portion, to solely support the web with a patient on it. The procedure may also include a step wherein a rocking device is used that acts through the web support system to selectively tilt the web and thereby to tilt the patient on the patient contact portion of the web, so that the pressure between the patient and the web is cyclically altered.

BRIEF DESCRIPTION OF THE SEVERAL VIEWS OF THE DRAWING

The character of the invention, however, may best be understood by reference to one of its structural forms, as illustrated by the accompanying drawings, in which.

DETAILED DESCRIPTION OF THE INVENTION

Figure 1:
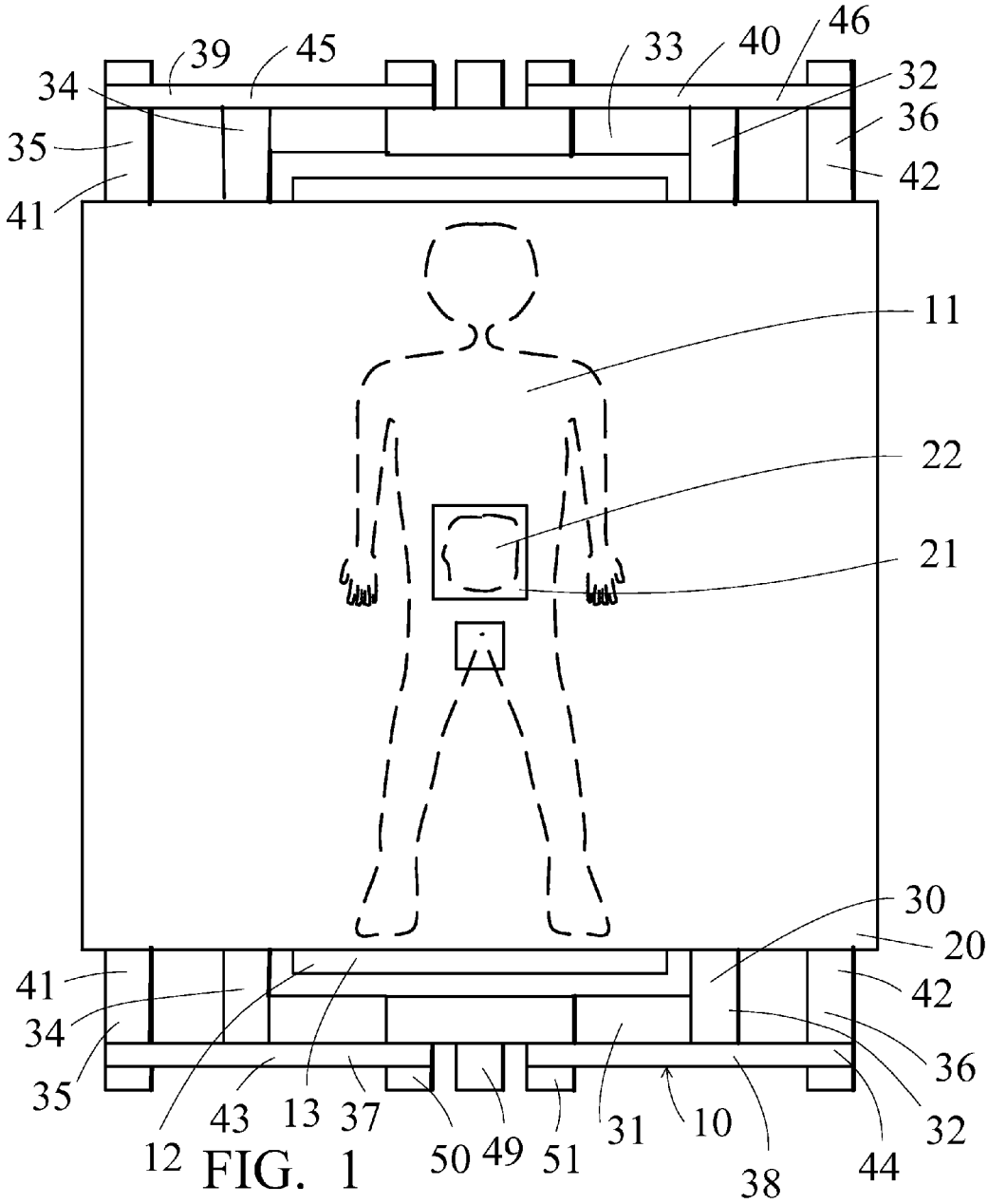
FIG. 1 is a diagrammatic plan view of an embodiment of the present decubiti ulcer treatment invention, showing the patient outlining dashed lines.

The device, generally denominated in the figures by the 10, we have developed for Decubiti ulcer patients (such as the patient 11 shown in dashed lines in FIG. 1 and solid lines in the other figures) will rotate a patient 11, preferably, at least every 2 hours, mechanically and automatically, on a disposable pad or web 20 that will allow a hole 21 to be cut in the pad underlying the area of ulceration 22 to further minimize any pressure, maximize air flow for healing, and decrease the risk of infection.

The preferred embodiment of the invention is a hammock-like device that can be installed over and around a hospital bed 12. The fundamental concept of this system to assist patients with or at risk of getting Decubiti ulcers is to raise the patient's body from a bed mattress 13, position the body 11 (as viewed from hip to hip) at an angle from the horizontal (up to 90 degrees, but typically not more than 25-30 degrees), to provide the patient with this support while lying on a disposable pad 20. The pad 20 can be cut with scissors or a knife to provide a hole 21 where the ulcer 22 can be exposed to air, when the pad is raised above the mattress 13.

In the preferred embodiment of the invention, an independent device frame 30 is located around the perimeter of the patient's bed frame 14. The device frame 30 can be adjusted in height, and can be supported from the floor by pads or casters. The frame 30 of the Decubiti bed system is assembled in four (or other quantity) of sections 31, 32, 33, and 34 around the circumference of an existing bed 12. Each piece of the device frame can be connected with the other pieces of the device frame others, at the corners, with a pin arrangement, a nut/bolt, or other type of snap connection. The frame, once assembled, is maintained above the floor level with a leg near each corner. Each leg has either a pad or caster wheel at the bottom. This leg may be adjusted in length by a pin/hole arrangement, or a hand crank/gearing system. The purpose of this adjustment is to raise the device frame relative to the top of the bed mattress, and to adjust the angle of the bed frame relative to the horizontal plane. This, in turn, adjusts the horizontal tubes 35 and 36 or other structures that support the pad or web 20 on which the patient is lying.

In the preferred embodiment of this invention, the device frame holds two pairs of arms pivotally 37, 38, 39, and 40 mounted to the device frame 30. Each pair of arms supports one of two co-axial tubes 35 and 36 that are positioned along each side the bed 12, lengthwise or longitudinally. Thus one of the coaxial tubes 35 and 36 are positioned along each side the bed mattress 13, in the head to foot direction. In the preferred embodiment, the inner tube 41 and 42 of each coaxial tube is a structural support, with each end connected to one of the four arms. Each pair of arms that are associated with a specific coaxial tube includes a driving arm 43 and 44 and a follower arm 45 and 46. The driving arm 43 and 44 can be located at the foot of the bed 12, and the follower arm 45 and 46 is located at the head end of the bed. The driving arm 43 and 44 is pivoted by mechanisms described below, and the follower arm 45 and 46 is essentially driven by the action of the driving arm 43 and 44, acting through the inner arm 41 and 42 of the coaxial tubes 35 and 36.

In the preferred embodiment of this invention, the external tube 47 and 48 of the coaxial tube 45 and 46 is rotated by a motor/gear arrangement 49 mounted to the device frame 30. Each external tube 47 and 48 carries one side of the web 20, and has that side of the web attached to the corresponding external tube. As each external tube 47 and 48 is separately commanded to rotate upon the structural tube 41 and 42. When one or both of the external tubes 47 and 48 is rotated to wrap the web around the tube, the suspended portion of the web 20 is decreased, thus raising the patient above the bed mattress 13. When one or both of the external tubes 47 and 48 is rotated to unwrap the web 20 from around the tube 35 and 36, the length of the suspended portion of the web is increased, thus lowering the patient toward or onto the bed mattress 13.

The co-axial 35 and 36 tubes can be independently raised or lowered by changing the angle of the driving arms 37, 38, 39, in 40 with reference to the device frame 30. Each end of each coaxial tube 35 and 36 is connected to an arm that is (in a preferred embodiment of the invention) pivotally mounted to the device frame 30. There are two arms 37 and 38 at the foot and two arms 39 and 40 at the head of the bed 12. A motor driver arrangement 49 is mounted to the device frame 30 and adapted to raise or lower the co-axial tubes 35 and 36 by rotating the driving arms 37 and 38 about their pivot axes. The non-driven or "follower" arms 39 and 40 at the other end of the bed, which provide a connection point for the associated coaxial tubes 35 and 36 and the movement of the follower arms 39 and 40 is achieved by the driving arms 37 and 38 acting through the structural tube 41 and 42 of the coaxial tubes 35 and 36, but the "follower" arms 37 and 38 are not directly driven by a motor. However, a motor/gearbox, etc. type of system can be installed to operate the "follower" arms, if desired. In the preferred embodiment of the invention, the end of each arm 37, 38, 39, and 40 that is not connected to the co-axial tubes 35 and 36 is pivotally connected to the system frame 30 and provides a pivot point for raising/lowering the co-axial tubes.

One of the two opposite edges of a soft, sheet like web 20 is attached to exterior of each of the two co-axial tubes 35 and 36 and creates a hammock over the bed mattress. The soft, sheet like web 20 is placed under the patient, and over the bed mattress 13. The sides of the web 20, alongside the length of the mattress 13, are connected to the exterior co-axial tube 35 and 36 on each side.

The external co-axial tubes 47 and 48 are rotated about the internal or structural coaxial tubes 41 and 42 by motors to provide a means for winding the edges of the web on or off the external coaxial tubes 47 and 48. The edges of the web are attached to the external coaxial tubes 47 and 48. The coaxial tubes 47 and 48 are rotated by an appropriate motor, gearing, or gearbox arrangement mounted to the device frame 30.

The soft web material web 20 can be attached to the co-axial tubes 35 and 36 before wind-up (rotation) by a VELCRO® fastener, double sided sticky tape, a clamp on the tube, or a chemical-based glue that provides sufficient adhesion of the web to the tubes, but allows the web to be removed from the tube went desired. This is the preferred mechanism of attaching the pad or web 20 to the co-axial tubes 35 and 36. Any type of friction system or string tie method where the web 20 is fixed to the surface of the coaxial tube 47 and 48 as the co-axial tube 47 and 48 is rotated until the pad goes over itself is an acceptable method of attachment.

The structural or internal tube 41 and 42 of the co-axial tubes 35 and 36 is used to transmit force from the arm 37 and 38 located at one end (for example, the foot) of the bed to the arm 39 and 40 located at the other end (for example, the head) of the bed. The non-driving arms 39 and 40 at the end of the co-axial tubes provides support in order for the tube 35 and 36 to maintain a desired generally horizontal position with reference to the floor.

The independent arms 37 and 38 located at the driven (and preferably be foot) of the bed 12 are each driven by a separate motor 50 and 51 or by independent drivetrains powered by a single motor. The driving mechanism 50 and 51 for each arm 37 and 38, which raises/lowers the co-axial tubes 35 and 36 by rotating the arm 37 and 38 about its pivot, is a motor/gearbox, or lead screw drive system 49.

The patient's body 11, lengthwise, can be manually tilted at an angle from zero degrees (for example, when the patient is laying flat on his back), to an angle of 90 or −90 degrees (for example when the patient is fully rolled over onto his side).

The freedom of movement of each arm 37, 38, 39, and 40 covers a wide arc. Each arm 37, 38, 39, and 40 can be individually positioned such that it is below the level of the mattress (generally horizontal), the arm can be positioned so that it is 90 degrees from the reference top of the mattress (generally vertical), and any positions between those extremes.

The patient 11 is strapped into the web 20 for safety reasons, that is, so that the patient is unable to fall off of the web 20. The patient 11 is restrained on the web between the two co-axial tubes 37 and 38 by a strap arrangement, or large scale fish net material, to prevent injury due to falling out of the sling type of arrangement.

In the preferred embodiment of the invention, the arms 37 and 38 that control the position and rotational angle of the outer co-axial tubes 35 and 36 can be manually controlled by a switch panel at the foot of the bed. There are a number of methods to control the rotation of the external co-axial tube 47 and 48 and arm position. An appropriate switch panel will be mounted at the foot-of-the-bed portion of the system frame to provide manual operation. The wind-up of the web 20 material on the coaxial tubes 47 and 48 can be manually controlled by a switch panel at the foot of the bed. An appropriate multi-function foot switch design can provide a manual method of system control, co-axial tube rotation, and arm position. The control of the system can be with a foot pedal arrangement near the bed.

The controlling foot pedal arrangement can also be connected by a long cable, so that it can be placed at any position around the system frame 30.

Rotation angle of the patient 11 is completely under the control of the operator. The adjustment of patient 11 rotation is under the control of the system operator, and not the patient.

When a patient 11 with a Decubiti ulcer is positioned on the web 20 in the desired position and orientation, the portion of the web 20 that would be in contact with the ulcer 22 is identified and marked. Then, an opening 21 can be cut in the web 20, in an appropriate manner, to fully expose the Decubiti ulcer, and to remove all contact between the ulcer 22 and the web 20, and all pressure on the wound 22. The method of exposing the Decubiti ulcer 22 to the air for proper healing is to cut an appropriate sized hole 21 in the web to allow the ulcer 22 to not touch the web nor the mattress, once the web 20 is lifted off of the mattress 13.

The soft, sheet like, disposable web 20 is formed of a material that will support the size of the hole without tearing. In the preferred embodiment, the web material is manufactured with a non-directional weave pattern so as to not tear when a hole is cut to expose the Decubiti ulcer 22.

A donut shaped pillow can be inserted around the ulcer, between the patient 11 and the web 20. If necessary, a donut shaped supporting pillow, or additional pad can be placed around the Decubiti ulcer for additional support, and to provide a "dam" to keep body fluids (incontinence) from coming in contact with, and irritating or infecting, the ulcer.

The system has a control button to expedite the lowering of the patient on to the mattress if a medical emergency develops ('coding'). A single control button will lower the patient onto the bed mattress in the event that emergency medical care is necessary.

The system has appropriate electrical stops for safety of movement for the patient and the operator. Each direction of movement will have a maximum position of travel (end stop) to control the limits of movement.

The preferred embodiment of the invention does not affect, in any way, the tilting utility of the hospital bed. The Decubiti ulcer treatment system surrounds a generic hospital bed and does not affect or render unusable any of the standard bed movement functions.

An RFID or bar code tag can be inserted into each web 20 to track usage. Each pad 20 can be provided with an industry standard RFID tag to catalog usage. The system electronics will read and record the pad RFID tags to keep an accounting of usage. The standard frame positioning system will be able to read and store the RFID tag information.

In an alternative embodiment, an accessory frame will be provided which can hold a mattress, independent of a bed frame within the standard frame design. The Decubiti system is designed to function in conjunction with a standard hospital bed, or twin bed size mattress/frame for home health care implementation. An accessory frame can be connected to the frame, which will support a twin size bed mattress, so that a conventional bed is not necessary to the operation of this device.

The electronics system will have a battery back-up feature to lower the patient onto the bed in the case of primary power failure. The electronics system will have a battery back-up feature, in the event that prime power is lost, which will allow the patient to be lowered onto the mattress.

Although the operation of the present device can be controlled manually, computer control is also possible. The positioning of the motor driven co-axial tubes can be accomplished under computer control. The rotation and re-positioning of a patient can be done completely by computer control (programming algorithm) without operator intervention. The vertical height of the co-axial tubes can be adjusted manually, or under computer control. The rotation and re-positioning of a patient can be done completely by computer control (programming algorithm) without operator intervention. The rotation sequence can be stored in computer memory for later print-out, or can be transmitted to a remote site using standard networking (internal network or Internet) technology. The rotation sequence can be driven from a remote site using standard network technology.

This system can be used for patient care without a conventional hospital bed, by providing and employing an accessory mattress support frame as part of the device frame.

Motors controlling the arms 37, 38, 39 and 40 connected to the co-axial tubes 35 and 36 can be installed at one end of the bed or at both the head and foot of the bed.

This entire rotational parts (assembly) can be connected to the bed frame, eliminating the need for the standard independent frame 30.

The system can be used with a standard, non-tilting bed, such as a standard twin bed mattress and frame. Thus, the system can be used in a health care facility or at home. Use of the device is location and facility independent.

The web 20 can also be attached to the device frame with strings, or web netting. These are alternative methods to attach the pad to the co-axial tube frame.

The tilt angle of the patient can rotate to 90 degrees in each direction, that is, if the patient starts out lying on his back, the device can roll a patient over completely onto his right side (90°) or completely onto his left side (90°), for a total cycle of 180°.

The arm 37, 38, 39, and 40 end stop position can be adjusted from 0 degrees to a full 90 degrees of movement.

In an alternative embodiment of this invention, all motors in this invention can be replaced with hand cranks, so that the device can be operated without electricity.

The switch panel can be located in other positions, besides or in addition to the foot of the bed. The switch panel can be located anywhere around the bed on the frame system.

The system can be broken down into sections of rotation along the patients longitudinal axis, where each section can be raised or lowered independently from each other (like a hospital bed where the head can be raised/lowered and not affecting the remainder of the bed.

An alternative design of the co-axial tubes can include one or more universal joint hinges that can allow the patient's head area to be elevated relative to the foot area, or vice versa. This system could have the equivalent movement of independently raising/lowering the head, mid body, and feet positions, relative to one another.

The switch panel can be implemented by using a device such as a laptop or palm computer, or equivalent. The switch panel can be replaced with a lap-top computer, PDA device, or other hand held computer system in lieu of discrete switches for adjustment control. The system can be controlled by a remote wireless device, equivalent in concept to a tv remote control, and be offered to the patient for personal minor adjustment. Adjustment control can be implemented with the same concept as a wireless remote control device (such as a tv remote).

The entire assembly can be tilted up or down (the head can be raised higher than the foot portion, or the foot portion is raised higher than the head).

The standard design can be implemented to adjust the head/foot height above the floor, independently.

A camera can be attached to a support on the invention to remotely monitor the patient for comfort and positioning. A camera system with network or Internet interface, can be installed to monitor the position of the web and the position of the patient on the way. This could allow remote adjustment of the patient position.

The system has a UPS supply (battery back-up) to maintain patient control in the event of a limited power outage.

The system has an electronic key card, memory chip, or other similar device that will enable/disable all functional operation. For rental applications, a method will be provided to enable or disable full operation, depending upon the rental agreement. The system will also be able to be enabled/disabled from an internet connection. The method of system enable/disable can be updated thru an Internet communication connection.

The system software will be able to be updated from an Internet connection. System software upgrades will be able to be completed thru an Internet down load connection.

All system positional information will be stored within the device control computer and will be able to be up loaded to a remote site, stored on a current technology storage device (CD or memory stick, etc).

In an alternative embodiment of the invention, the system can be created by designing individual vertical lift points at the four corners of the bed, rather than employing the arm movements.

The system will have the ability to 'weigh' the patient by calculating weight from the forces measured by the web attached to the lifting roller tubes. This feature will allow medical personal to determine weight gain, which can be used as an indication of fluid build-up in the patient.

The system will have, as an option, a small humidifier/dehumidifier, air fan, and short hose system that can be located under a wound. The purpose of this airflow is to gently bathe the wound with either warm/cold air, at a preset humidity to assist in the healing process.

This invention has a number of benefits. First, the Decubiti ulcer (sore) is completely lifted from the mattress and is exposed to the air to promote healing (pad cut out). Second, the hammock angle can be adjusted by manual or power-assisted operator action, or by computer control. Third, the rotational sequence can be stored in computer memory for later retrieval. Fourth, the system can be remotely monitored and controlled. Fifth, the soft "sheet like" web is disposable. Six, the patient can be cared for and the rotating process carried out by a single medical attendant.

From one perspective, the Decubiti ulcer management system of the present invention can have two different modes of operation. In prevention mode, the purpose of the operation is to prevent ulcers. In the treatment mode, the purpose of the operation is to enhance the healing of an existing ulcer.

Figure 2:
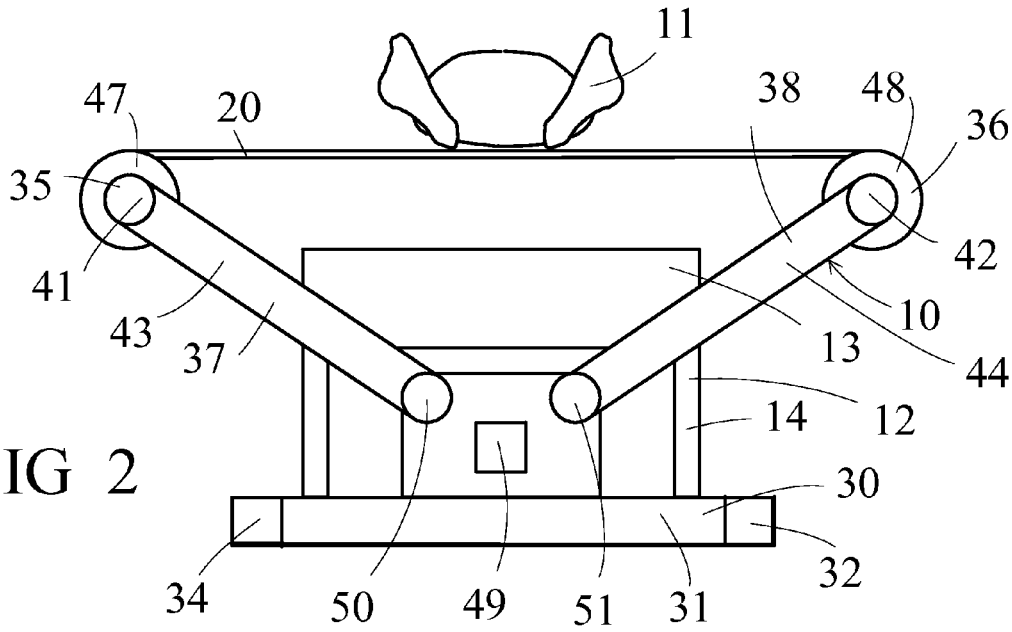
FIG. 2 is a diagrammatic front elevation view of an embodiment of the present invention shown in FIG. 1, in which the web is substantially horizontal.

In the prevention mode, the web 20 could be unwound from the left to 35 and lowered to the bed mattress 13. Simultaneously, the arms 37 and 39 could be rotated so that their outer ends become adjacent to the floor thereby allowing easy patients access to web 25 years position on the top of the bed. The patient 11 would be placed on the web 20. Then, the arms 37 and 39 would be rotated so that their outer arms are elevated above the top of the bed 12, in the Web 20 would be wound on the tubes 35 and 36 so that the web 20 would be lifted off the mattress 13, and so that the patient 11 would be supported entirely by the web 20, as the web 20 is positioned above and separated from the mattress 13. This position is shown in FIG. 2. Then, the outer ends of the arms 37, 38, 39, and 40 would raise and lower the tubes 35 and 36 so that the web 20 would be manipulated through a slow cyclic pattern and so that the patient 11 the patient would go through a slow cycle of being rotated onto one side of the patient and over to the other side of the patient, so the weight of the patient would be continuously moved from one part of the patient's body to another. In this way, no one part of the patient would be continuously exposed to the pressure of the patient's weight, blood circulation throughout the exterior of the patient would be encouraged, and the incidence of Decubiti ulcers would be significantly reduced.

Figure 3:
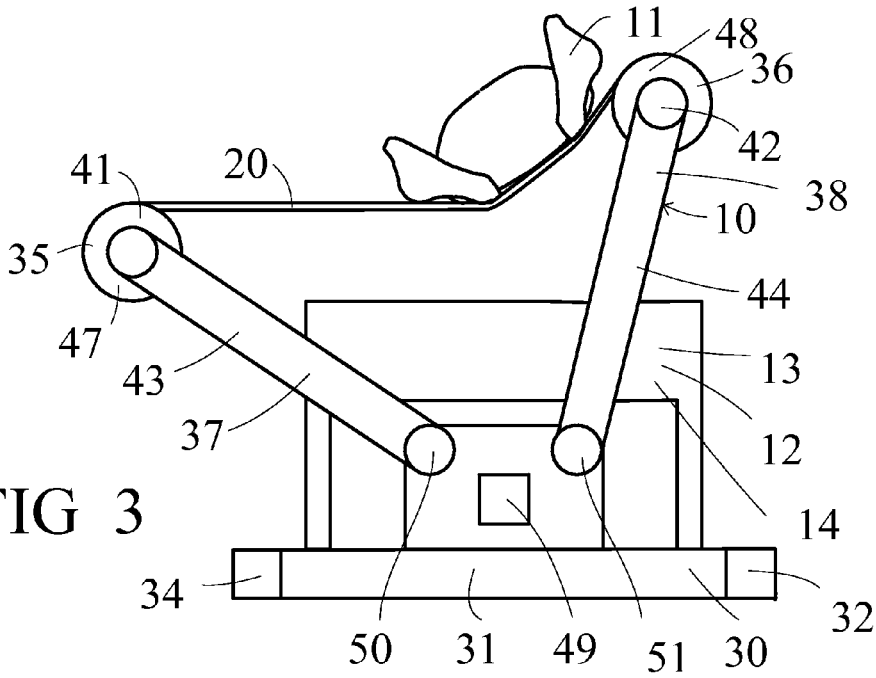
FIG. 3 is a diagrammatic front elevation view of an embodiment of the present invention shown in FIG. 1, in which the web is configured to tilt the patient.

FIG. 3 shows the point in the cycle in which the Web 20 is rolled onto the tube 36 as the arms 38 and 40 are pivoted counterclockwise and the tube 36 is moved upward. This results in the patient being tipped counterclockwise so that the pressure caused by the weight of the patient 11 is transferred toward the right side of the patient. At the other end of the cycle, the Web would be unrolled from the tube 36 as tube 36 is lowered and web 20 would be rolled on to tube 35 as tube 35 is raised. This would tip the patient on to the patient's's left side. When it is time to remove the patient from the bed and equipment, the system could be returned to its original position to allow the patient to be easily removed from the bed and equipment.

in the treatment mode, the process would be essentially the same as in the prevention mode except that an opening 21 would be cut in the portion of the Web 20 that surrounds the ulcer 22 so that the pressure caused by the weight of the patient would not exist in the area of the ulcer 22, since the ulcer 22 would not be in contact with the supporting web 20. Not only would the ulcer 22 be free of contact with any supporting surfaces, and also free of the pressure of the patients weight, but also the ulcer would be exposed to air, and blood circulation would not be inhibited. Thus, the hole in the supporting web, by itself, would encourage the healing of the ulcer. By including the slow and cyclic tilting of the patient as in the prevention mode, not only what additional ulcers be prevented, but the split circulation that would be encouraged by the tilting motion would also enhance the healing process of the ulcer.

While it will be apparent that the illustrated embodiments of the invention herein disclosed are calculated adequately to fulfill the object and advantages primarily stated, it is to be understood that the invention is susceptible to variation, modification, and change within the spirit and scope of the subjoined claims. It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desire to secure by Letters Patent is:

1. A procedure for preventing Decubiti ulcers on patients, comprising the steps of:

a. placing the patient on a web adapted to support the patient, the web having a patient contacting portion and a non-patient contacting portion, b. using a web support system, including two tubes, one of each is positioned on each side of the patient, with the web attached to each tube and suspended between the two tubes, and the web support system being adapted to adjust the width of the web that is suspended between the two tubes by rotating the tubes, and the web support system being adapted to tilt the web by raising and lowering the tubes with respect to one another, c. using a rocking device that is pivotally connected to the web support system and acts through pivotal motion within the web support system to selectively raise and lower the two tubes with respect to one another to tilt the web and thereby to tilt the patient on the patient contact portion of the web, so that the pressure between the patient and the web is altered, and d. using the web width adjusting feature of the web support system to reduce the width of the web that is suspended when that patient is positioned on one side and on the other side to maximize the angle by which the patient is turned.

2. A procedure for enhancing healing of Decubiti ulcers on as recited in claim 1, comprising the steps of:

a. placing the patient on a web adapted to support the patient, the web having a patient contacting portion and a non-patient contacting portion, the web having an opening through the web, positioned so that the opening surrounds the ulcer and prevents contact of the web with the ulcer, b. using a web support system adapted to support the web by attachment only to the non-patient contacting portion, to solely support the web with a patient on it.

3. A procedure for preventing Decubiti ulcers on patients, comprising the steps of:

a. placing the patient on a web adapted to selectively be the sole support for the patient, the web having a patient contacting portion and a non-patient contacting portion, b. using a web support system, including two tubes, one of each is positioned on each side of the patient, with the web attached to each tube and suspended between the two tubes, and the web support system being adapted to adjust the width of the web that is suspended between the two tubes by rotating the tubes, and the web support system being adapted to tilt the web by raising and lowering the tubes with respect to one another, c. using a rocking device that is pivotally connected to the web support system and acts through pivotal motion within the web support system to selectively raise and lower the two tubes with respect to one another to tilt the web and thereby to tilt the patient on the patient contact portion of the web, so that the pressure between the patient and the web is altered, and d. using the web width adjusting feature of the web support system to reduce the width of the web that is suspended when that patient is positioned on one side and on the other side to maximize the angle by which the patient is turned.

4. A procedure as recited in claim 3, wherein a rocking device is used that acts through the web support system to selectively tilt the web and thereby to tilt the patient on the patient contact portion of the web, so that the pressure between the patient and the web is cyclically altered.

5. A procedure as recited in claim 3, wherein the web support system is provided with two parallel horizontal tubes, one of each is positioned on each side of the patient, with the web suspended between the two tubes, and the tubes being adapted to adjust the width of the web that is suspended between the two tubes.

6. A procedure for preventing Decubiti ulcers on patients, comprising the steps of:

a. placing the patient on a web adapted to selectively be the sole support for the patient, the web having a patient contacting portion and a non-patient contacting portion, b. using a web support system, including two tubes, one of each is positioned on each side of the patient, with the web attached to each tube and suspended between the two tubes, and the web support system being adapted to adjust the width of the web that is suspended between the two tubes by rotating the tubes, and the web support system being adapted to tilt the web by raising and lowering the tubes with respect to one another, c. using a rocking device that acts through the web support system to selectively raise and lower the two tubes with respect to one another to tilt the web and thereby to tilt the patient on the patient contact portion of the web, so that the pressure between the patient and the web is altered, and d. using the web width adjusting feature of the web support system to reduce the width of the web that is suspended when that patient is positioned on one side and on the other side to maximize the angle by which the patient is turned.

7. A procedure for enhancing healing of Decubiti ulcers on patients, as recited in claim 6, comprising the steps of:

a. placing the patient on a web adapted to support the patient, the web having a patient contacting portion and a non-patient contacting portion, the web having an opening through the web, positioned so that the opening surrounds the ulcer and prevents contact of the web with the ulcer, b. using a web support system adapted to support the web by attachment only to the non-patient contacting portion, to solely support the web with a patient on it.

8. A procedure as recited in claim 6, wherein a rocking device is used that acts through the web support system to selectively tilt the web and thereby to tilt the patient on the patient contact portion of the web, so that the pressure between the patient and the web is cyclically altered.

9. A procedure as recited in claim 6, wherein the web support system is provided with two parallel horizontal tubes, one of each is positioned on each side of the patient, with the web suspended between the two tubes, and the tubes being adapted to adjust the width of the web that is suspended between the two tubes.

10. A procedure as recited in claim 9, wherein each horizontal tube is comprised of an inner tube that is supported by the web support system, and an outer tube coaxial with the inner tube and to which the web is attached, and a rotating means adapted to rotate the outer tube with respect to the inner tube to adjust the width of the web that is suspended from the horizontal tubes.

* * * * *